US007563333B2

(12) United States Patent
Sandberg et al.

(10) Patent No.: US 7,563,333 B2
(45) **Date of Patent: *Jul. 21, 2009**

(54) PROCESS FOR PRODUCING STEEL ARTICLE

(75) Inventors: Odd Sandberg, Uddeholm (SE); Lennart Jönson, Karlstad (SE)

(73) Assignee: Uddeholm Tooling Aktiebolag, Hagfors (SE)

( * ) Notice: Subject to any disclaimer, the term of this patent is extended or adjusted under 35 U.S.C. 154(b) by 363 days.

This patent is subject to a terminal disclaimer.

(21) Appl. No.: 11/441,085

(22) Filed: May 26, 2006

(65) Prior Publication Data

US 2006/0231172 A1 Oct. 19, 2006

Related U.S. Application Data

(63) Continuation of application No. 10/473,230, filed on Sep. 29, 2003, now abandoned.

(30) Foreign Application Priority Data

Apr. 25, 2001 (SE) ..... 0101438
May 18, 2001 (SE) ..... 0101785

(51) Int. Cl.
*C21D 9/00* (2006.01)

(52) U.S. Cl. ..... 148/543; 148/545; 148/663; 164/46

(58) Field of Classification Search ..... 148/543–545, 148/663, 321, 324, 334, 326, 328; 164/46
See application file for complete search history.

(56) References Cited

U.S. PATENT DOCUMENTS

| | | | | |
|---|---|---|---|---|
| 4,066,117 | A * | 1/1978 | Clark et al. | 164/46 |
| 4,221,612 | A | 9/1980 | Thome | 148/616 |
| 5,316,596 | A | 5/1994 | Kataoka | 148/321 |
| 5,514,065 | A | 5/1996 | Noda et al. | 492/58 |
| 5,900,560 | A | 5/1999 | Pinnow et al. | 75/246 |
| 5,976,277 | A * | 11/1999 | Park et al. | 148/543 |

(Continued)

FOREIGN PATENT DOCUMENTS

JP 63-169361 7/1988

(Continued)

OTHER PUBLICATIONS

Computer-generated English translation of Japanese patent 06-158262, Hatano et al., Jun. 7, 1994.*

(Continued)

*Primary Examiner*—Deborah Yee
(74) *Attorney, Agent, or Firm*—Barnes & Thornburg LLP

(57) ABSTRACT

The invention concerns an article of a steel which is characterized in that it consists of an alloy which contains in weight-%: 1.2-2.0 C, 0.1-1.5 Si, 0.1-2.0 Mn, max. 0.2 N, max. 0.25 S, 4-8 Cr, 0.5-3.5 (Mo+W/2), 5-8 V, max. 1.0 Nb, balance essentially only iron and unavoidable impurities, and that the steel has a micro-structure obtainable by a manufacturing of the steel which comprises spray forming of an ingot, the microstructure of which contains 8-15 vol-% carbides of essentially only MC-type where M substantially consists of vanadium, of which carbides at least 80 vol-% have a substantially rounded shape and a size in the longest extension of the carbides amounting to 1-20 μm.

35 Claims, 7 Drawing Sheets

U.S. PATENT DOCUMENTS

| | | | | |
|---|---|---|---|---|
| 6,200,394 | B1 * | 3/2001 | Park et al. | 148/321 |
| 6,348,109 | B1 * | 2/2002 | Sandberg | 148/324 |
| 6,511,554 | B1 | 1/2003 | Kawano et al. | 148/324 |

FOREIGN PATENT DOCUMENTS

| | | | |
|---|---|---|---|
| JP | 5-339673 | | 12/1993 |
| JP | 06-158262 | * | 6/1994 |
| JP | 406346186 | | 12/1994 |
| JP | 63-169361 | | 7/1998 |

OTHER PUBLICATIONS

Derwent-Acc-No. 1994-222485, English abstract of Japanese patent 06-158262, Hatano et al., Jun. 7, 1994.*

Office Action from the Korean Patent Office dated Feb. 27, 2008 for Korean Patent Application No. 10-2003-7013967.

WPI, Derwent, JP5339673 A, (KAWI) Kawasaki Steel Corp.; "Wear Resistant Roll Outer Layer Material For Composite Roll—Comprises Carbon, Silicon, Manganese@, Chromium@, Molybdenum@, Vanadium@, Niobium and Iron@"; 9931221.

Rejection Notice dated May 16, 2007; Japanese Patent Application No. 2002-583689 with English Translation (6 pgs).

* cited by examiner

PROCESS FOR PRODUCING STEEL ARTICLE

This application is a continuation of application Ser. No. 10/473,230, filed Sep. 29, 2003, now abandoned the entire content of which is hereby incorporated by reference in this application.

TECHNICAL FIELD

The invention concerns a steel article having excellent wear resistance, good hardenability and tempering resistance, and adequate hardness and good toughness not only in the longitudinal direction of the steel material, i.e. in its working direction, but also in the transversal direction, and which also is favorable from a cost point of view; features which make the steel suitable to be used within several fields of application, including the following:

- elements, e.g. screws and barrels for feeding and conducting plastic masses in machines for the manufacturing of plastic components, e.g. elements in injecting molding and extrusion assemblies,
- mould tools and tool parts for injection molding of plastic materials,
- wear parts, e.g. details in pumps for feeding wearing media, as well as other wear parts in machines,
- knives with good toughness for disintegrating, e.g., plastic materials and wood, comprising also chipper knives,
- hot work tools,
- trimming tools for burring cast or pressed articles, which may be hot or cold, and
- sleeves for composite rolls included in rolling mills.

BACKGROUND OF THE INVENTION

For some of the above mentioned fields of application there is presently used a steel of a conventional kind of type AISI D2 but also powder metallurgy manufactured high speed steels and cold work steels having a high content of carbides.

However, there is a demand of a qualified steel which does not require powder metallurgy manufacturing but which may be manufactured in a way which affords some desirable features of the steel and of the article that is made of the steel, at the same time as the manufacturing should be advantageous from an economical point of view. More specifically there is demand of a steel which affords an excellent wear resistance, good hardenability, good ductility and machinability, adequate hardness and good tempering resistance, which makes the steel suitable for articles within the above mentioned fields of application.

DISCLOSURE OF THE INVENTION

It the purpose of the invention to provide a steel article which satisfies the above mentioned demands. This can be achieved therein that the article is made of a spray-formed steel material having a chemical composition in weight-% and a micro-structure which is stated in the appending patent claims.

Further, as far as the included alloy elements in the steel are concerned, the following applies.

Carbon shall exist in a sufficient amount in the steel in order, in the hardened and tempered condition of the steel, to form 8-15 vol-%, preferably 10-14.5 vol-%, MC-carbides, where M substantially is vanadium, and also exist in solid solution in the martensitic matrix of the steel in the hardened condition of the steel in an amount of 0.1-0.5 weight-%, preferably 0.15-0.35 weight-%. Suitably, the content of the dissolved carbon in the matrix of the steel is about 0.25%. The total amount of carbon in the steel, i.e. carbon that is dissolved in the matrix of the steel plus that carbon which is bound in the carbides, shall be at least 1.2%, preferably at least 1.3%, while the maximal content of carbon may amount to 2.0%, preferably max 1.9%. Suitably, the carbon content is 1.4-1.8%, nominally 1.60-1.70%.

The article according to the invention is manufactured by a technique which comprises spray forming, in which drops of molten metal is sprayed against a rotating substrate on which the drops rapidly solidify in order to form a successively growing ingot. The ingot subsequently can be hot worked by forging and/or rolling to desired shape. The said carbides are formed at the solidification of the drops, and as the ingot is formed of the drops, the carbides are evenly distributed in the ingot and thence in the finished product. Due to the controlled rate of solidification, which is slower than when metal powder is produced by atomising a stream of molten metal and rapid cooling of the formed drops, but essentially more rapid than in conventional ingot manufacturing, continuous casting and/or ESR-remelting, the carbides have sufficient time to grow to a size which has turned out to be very advantageous for the article of the invention. Thus the MC-carbides, which consist of primary carbides which are difficult to dissolve, are caused to achieve an essentially rounded shape. Individual carbides may be larger than 20 μm in the longest extension of the carbide, and many carbides may be smaller than 1 μm, but at least 80 vol-% of the MC-carbides get a size in the longest extension of the carbides amounting to 1-20 μm, preferably larger than 3 μm. A typical size is 6-8 μm.

Nitrogen optionally may be added to the steel in connection with the spray forming in a maximal amount of 0.20%. According to the preferred embodiment of the invention, however, nitrogen is not intentionally added to the steel but nevertheless exists as an unavoidable element in an amount of max. 0.15%, normally max. 0.12%, and is at that level not any harmful ingredient. In the above mentioned volume content of MC-carbides, thus also a minor fraction of carbonitrides may be included.

Silicon is present as a residue from the manufacturing of the steel and normally exists in an amount of at least 0.1%, possibly at least 0.2%. The silicon increases the carbon activity in steel and may therefore contribute to the achievement of an adequate hardness of the steel. If the content is higher, embrittlement problems may arise. Further, silicon is a strong ferrite former and must therefore not exist in amounts exceeding 1.5%. Preferably, the steel does not contain more than 1.0% silicon, suitably max. 0.65% silicon. A nominal silicon content is 0.35%.

Also manganese is present as a residue from the manufacturing of the steel and binds those amounts of sulphur which may exist in low amounts in the steel by forming manganese sulphide. Manganese therefore should exist in an amount of at least 0.1%, preferably in an amount of at least 0.2%. Manganese also improves the hardenability, which is favourable, but must not be present in amounts exceeding 2.0% in order that embrittlement problems shall be avoided. Preferably, the steel does not contain more than max. 1.0% Mn. A nominal manganese content is 0.5%.

Chromium shall exist in an amount of at least 4%, preferably in an amount of at least 4.2%, suitably at least 4.5%, in order to provide a desired hardenability to the steel. The term hardenability means the capacity to provide a high hardness more or less deep in the article which is being hardened. The hardenability shall be sufficient in order that the article shall be able to be through hardened even when the article has large dimensions, without the employment of very rapid cooling in oil or water at the hardening operation, which might cause dimension changes. The working hardness, i.e. the hardness of the steel after hardening and tempering, shall be 45-60 HRC. Chromium, however, is a strong ferrite former. In order to avoid ferrite in the steel after hardening from 980 to 1150° C., the chromium content must not exceed 8%, preferably max. 6.5%, suitably max. 5.5%. A suitable chromium content is 5.0%.

Vanadium shall exist in the steel in an amount of 5.0-8.0% in order together with carbon and optionally nitrogen to form said MC-carbides or carbonitrides in the martensitic matrix of the steel in the hardened and tempered condition of the steel. Preferably, the steel contains at least 6.0 and max. 7.8% V. A suitable vanadium content is 6.8-7.6%, nominally 7.3%.

In principle, vanadium may be replaced by niobium for the formation of MC-carbides, but for this twice as much niobium is required a compared with vanadium, which is a drawback. Further, niobium has the effect that the carbides will get a more edgy shape and be larger that pure vanadium carbides, which may initiate ruptures or chippings and therefore reduce the thoughness of the material. This may be particularly serious in the steel of the invention, the composition of which has been optimised for the purpose of providing an excellent wear resistance in combination with a high hardness and tempering resistance, as far as the mechanical features of the material are concerned. The steel therefore, according to an aspect of the invention, must not contain more than max 0.1% niobium, preferably max 0.04% niobium. Further, according to the same aspect of the invention, niobium may be tolerated only as an unavoidable impurity in the form of a residual element from the raw materials which are used in connection with the manufacturing of the steel.

However, according to a variant of the invention, the steel may contain niobium in an amount up to max. 1.0%, preferably max. 0.5%, suitably max. 0.3%. It can namely be assumed, that the harmful effect of niobium essentially can be inhibited by the high content of vanadium of the steel. This idea is based on the assumption that pure niobium carbides and/or carbonitrides hardly will appear in the steel. It is true that niobium carbides and/or niobium carbonitrides may be formed initially in the steel, but it is believed that vanadium carbides and/or vanadium carbonitrides will be built to such an extent on such initially formed niobium carbides and/or niobium carbonitrides that the harmful effect which would be due to the more egdy shape of the pure niobium carbides and/or carbonitrides essentially is eliminated. The same consideration applies if MC-carbides are formed in the form of mixed compounds of vanadium, niobium and carbon as well as corresponding mixed carbonitrides, wherefore in both cases the content of niobium is considered to be so small that, according to said variant of the invention, the negative roll of the niobium can be neglected.

Molybdenum shall exist in an amount of at least 0.5%, preferably at least 1.5%, in order to afford the steel a desired hardenability in combination with chromium and the limited amount of manganese. However, molybdenum is a strong ferrite former. The steel therefore must not contain more than 3.5% Mo, preferably max. 2.8%. Nominally, the steel contains 2.3% Mo.

In principle, molybdenum may completely or partly be replaced by tungsten, but for this twice as much tungsten is required as compared with molybdenum, which is a drawback. Also the use of any produced scrap will become more difficult. Therefore tungsten should not exist in an amount of more than max. 1.0%, preferably max. 0.5%. Most conveniently, the steel should not contain any intentionally added tungsten, which according to the most preferred embodiment of the invention is tolerated only as an unavoidable impurity in the form of a residue from the raw materials which are used in connection with the manufacturing of the steel.

Besides the mentioned alloy elements the steel does not need, and should not, contain any more alloy elements in significant amounts. Some elements are definitely undesired, because they may have undesired influence on the features of the steel. This is true, e.g., as far as phosphorus is concerned, which should be kept at as low level as possible, preferably at max 0.03%, in order not to have an unfavourable effect on the toughness of the steel. Also sulphur in most respects is an undesired element, but its negative effect on, in the first place, the toughness, essentially can be neutralised by means of manganese, which forms essentially harmless manganese sulphides, wherefore sulphur may be tolerated in a maximal amount of 0.25%, preferably max. 0.15%, in order to improve the machinability of the steel. Normally the steel, however, does not contain more than max. 0.08%, preferably max. 0.03%, and most conveniently max. 0.02% S.

Further features and aspects of the invention will be apparent from the following description of performed experiments and from the appending patent claims.

BRIEF DESCRIPTION OF DRAWINGS

In the following description of performed experiments, reference will be made to the accompanying drawings, in which.

DESCRIPTION OF PERFORMED TESTS

Materials

The material—the steel/the article—according to the invention may have the following nominal, chemical composition in weight-% according to a preferred embodiment: 1.60 C, 0.25 Si, 0.75 Mn, ≦0.020 P, ≦0.060 S, 5.00 Cr, 2.30 Mo, 7.30 V, ≦0.005 Ni, ≦0.005 Ti, ≦30 Ni, ≦0.25 Cu≦0.020 Al≦0.10 N balance iron and other impurities than the above mentioned. The performed tests aim at evaluating a material which closely corresponds with the above nominal composition, by comparing the material with some known reference materials which represent closest prior art.

The chemical compositions of the materials which are included in the test series are given in Table 1. Steel No. 1 has a composition according to the invention. This steel has been manufactured according to the so called spray forming technique, which also is known as the OSPRAY-method, according to which an ingot, which rotates about its longitudinal axis, successively is established from a molten material which in the form of drops which are sprayed against the growing end of the ingot that is produced continuously, the drops being caused to solidify comparatively rapidly once they have hit the substrate, however not as fast as when powder is produced and not as slow as in connection with conventional manufacturing of ingots or in connection with continuous casting. More specifically, the drops are caused to solidify so rapidly that formed MC-carbides will grow to the desired size according to the invention. The spray-formed ingot of steel No. 1 had a mass of about 2380 kg. The diameter of the ingot was about 500 mm. The spray-formed ingot was heated to a forging temperature of 1100° C. -1150° C. and was forged to the shape of blanks having the final diamention Ø 330, 105, and 76.5 mm, respectively.

Table 1 gives the analyzed composition of the spray-formed ingot according to the invention, steel No. 1, and of the analyzed composition of a commercially available steel, steel No. 2. Steel No. 3 is the nominal composition of the last mentioned steel according to the specification of the manufacturer. Steel No. 4 states the composition of still another commercially available steel. Steels No. 2, 3 and 4 are powder metallurgy manufactured steels. Besides the elements stated in Table 1, the steels only contain iron and other, unavoidable impurities than those which are stated in the Table.

Micro-Structure

Figure 1:
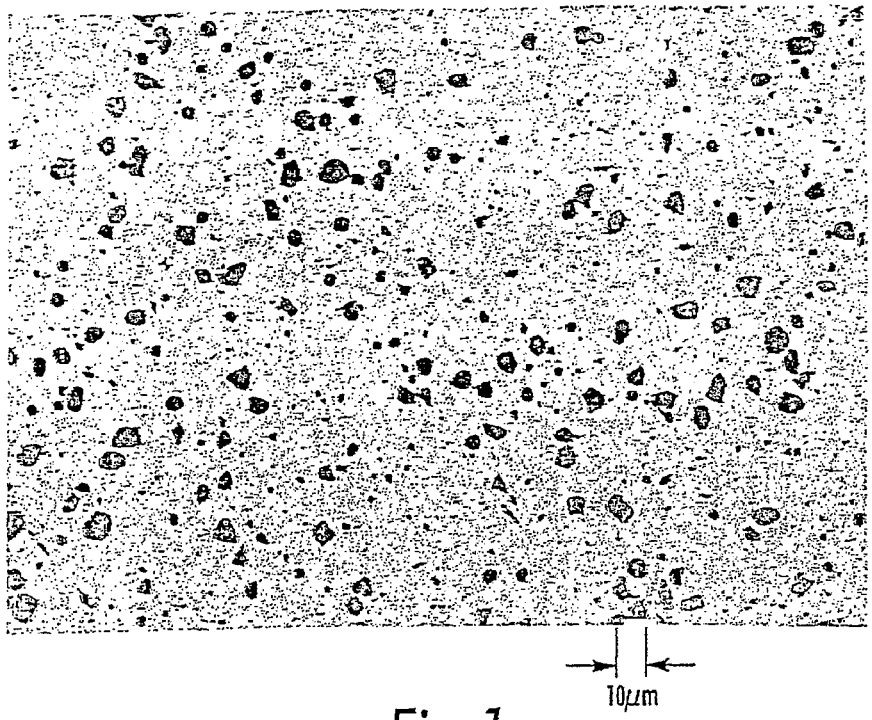
FIG. 1 is a photography which shows the micro-structure of a portion of an article according to the invention.
Figure 2:
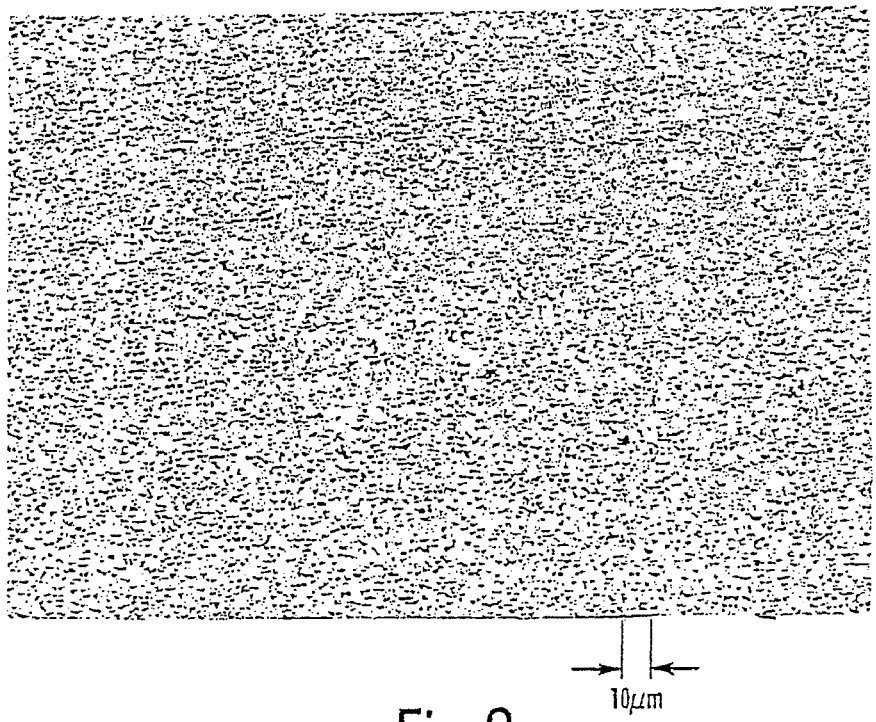
FIG. 2 shows the micro-structure of a portion of an article of a reference steel at the same scale as FIG. 1, FIG. 3 in the form of a bar chart shows the size distribution of carbides in a material according to the invention and in a reference material.
Figure 3:
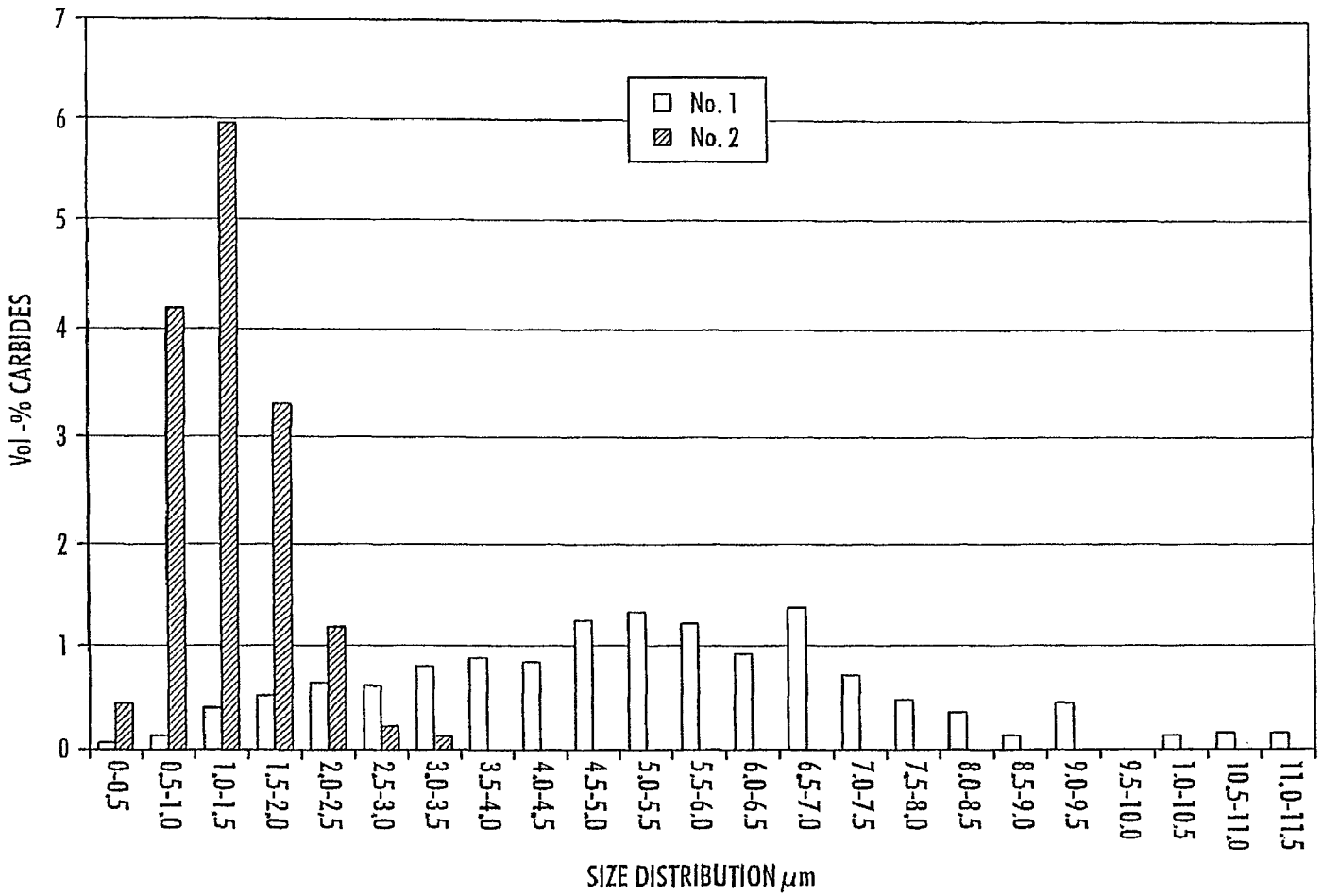

FIG. 1 shows a scanning electron microscopical picture of the micro-structure of a rod having the dimension Ø 105 mm made of steel No. 1. The material was hardened from $T_A$=1050° C./30 min and tempered at 525° C./2×2 h to a hardness of 56 HRC. FIG. 2 shows the micro-structure of steel No. 2, which had the shape of a rod with the dimension Ø 75 mm, after hardening from $T_A$=1060° C./60 min+tempering 525° C./2×2 h to a hardness of 54.5 HRC. Primary carbides of MC-type could be observed in the spray-formed material, FIG. 1, where M substantially consists of vanadium. The great majority of the carbides had sizes within the range of about 1-20 μm. The size distribution, however, was considerable as is shown by the bar chart in FIG. 3. The main part of the carbide volume thus represents carbide sizes between 2.0 and 10.0 μm and within that range there is a clear tendency that the carbides typically, i.e. the main part of the carbides with reference to volume, have a size between 3.0 and 7.5 μm. The total carbide volume was determined by the manual point counting method in a scanning electron microscope to be 13.1 vol-% MC-carbides in steel No. 1 and to be 15.4 vol-% in steel No. 2, respectively. In steel No. 2, however, the micro-structure was of a type which is typical for powder metallurgy manufactured steels, which means that all carbides were very small, max. about 3 μm. The great majority of the carbides had sizes within the range 0.5-2.0 μm and were evenly distributed in the matrix of the steel independent of the heat treatment. This can be observed visually by studying the micro photograph, FIG. 2, and is also evident from the bar chart in FIG. 3. The bar chart shows that the great majority of the MC-carbides in steel No. 2 had sizes between 0.5 and 2.0 μm.

TABLE 1

Chemical composition (weight-%) of tested materials

| Steel No. | C | Si | Mn | P | S | Cr | Mo | V | Nb | Ti | Ni | Cu | Al | N | Balance |
|---|---|---|---|---|---|---|---|---|---|---|---|---|---|---|---|
| 1 | 1.59 | 0.65 | 0.66 | 0.020 | 0.091 | 5.01 | 2.42 | 6.92 | 0.005 | 0.001 | 0.16 | n.a. | n.a. | 0.063 | iron and unavoidable impurities |
| 2 | 1.85 | 0.85 | 0.60 | 0.017 | 0.012 | 5.33 | 1.31 | 8.36 | n.a. | n.a. | 0.04 | n.a. | n.a. | 0.063 | iron and unavoidable impurities |
| 3 | 1.78 | 0.90 | 0.50 | — | — | 5.25 | 1.30 | 9.00 | — | — | — | — | — | — | iron and unavoidable impurities |
| 4 | 1.77 | 0.92 | 0.48 | — | <0.03 | 5.25 | 1.30 | 8.88 | — | — | — | — | — | — | iron and unavoidable impurities |

n.a. = not analyzed

In the studies which shall be described in the following, steels No. 1 and 2 were tested with reference to micro-structure hardness versus austenitising and tempering temperature hardenability ductility abrasive wear resistance As a comparison there has in one of the studies—the hardness versus austenitising and tempering temperature—also been included information concerning steel No. 4 according to the specifications of the manufacturer.

Hardness after Heat Treatment

The blanks which were made of steel No. 1 had a hardness (Brinell hardness) of 190-230 HB, typically about 200-215 HB in the soft annealed condition, independent of the dimensions of the blanks. The hardness of steel No. 2 was somewhat higher in the soft annealed condition; about 235 HB.

Figure 4:
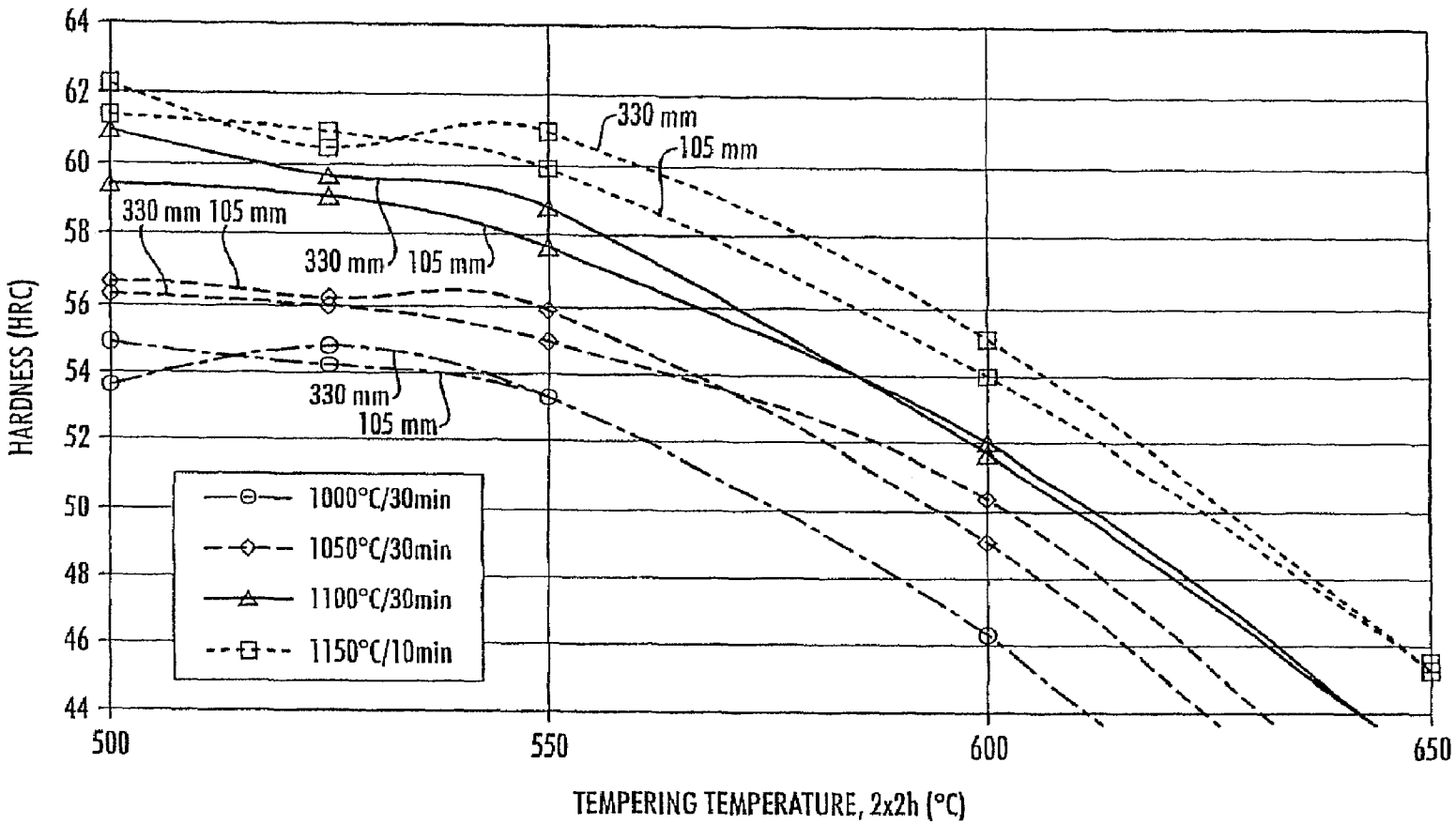
FIG. 4 shows a number of tempering curves, which illustrate the influence of the austenitising and the tempering temperatures on the hardness of a steel according to the invention.

The influence of the tempering temperature on the hardness of steel No. 1 of two blanks which had different dimensions, Ø 105 mm and Ø 330 mm, after austenitising at different temperatures between 1000 and 1150° C. is shown in FIG. 4. The highest hardness was reached after austenitising at 1150° C. and tempering at 550° C., 2×2 h. The lowest hardness was achieved after hardening from 1000° C. The curves in the diagram in FIG. 4 also show that a desired working hardness between 45 and 60 HRC can be achieved through choice of a tempering temperature between 525 and 650° C. after hardening from temperatures between 1000 and 1150° C. The difference in hardness between the two dimensions Ø 105 mm and Ø 330 mm, lies within the marginal of error of the hardness measurement.

Figure 5:
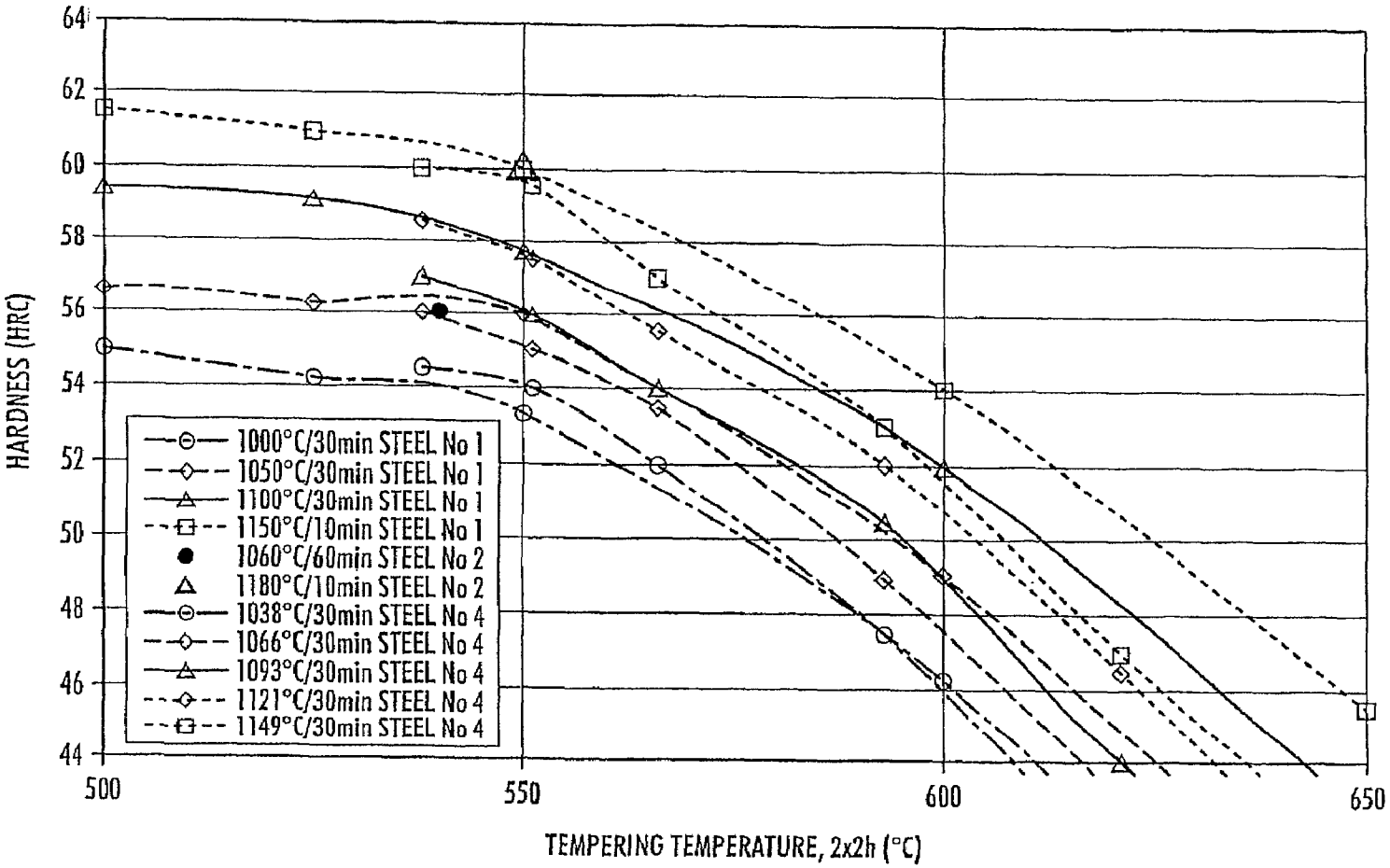
FIG. 5 shows a number of tempering curves which illustrate the influence of the austenitising and tempering temperatures on the hardness of a steel according to the invention and of two examined reference materials.

FIG. 5 illustrates the difference in response to tempering between steels No. 1 and No. 4. The curve of steel No. 2 is based on only two points. The curves in the diagram show that steel No. 1 gives a higher hardness than at least steel No. 4 after hardening from essentially the same austenitising temperatures. The tempering resistance of steel No. 1 also was better than that of steel No. 4. The article made of steel No. 1 consisted of a blank with the dimension Ø 105 mm.

Hardenability

Figure 6:
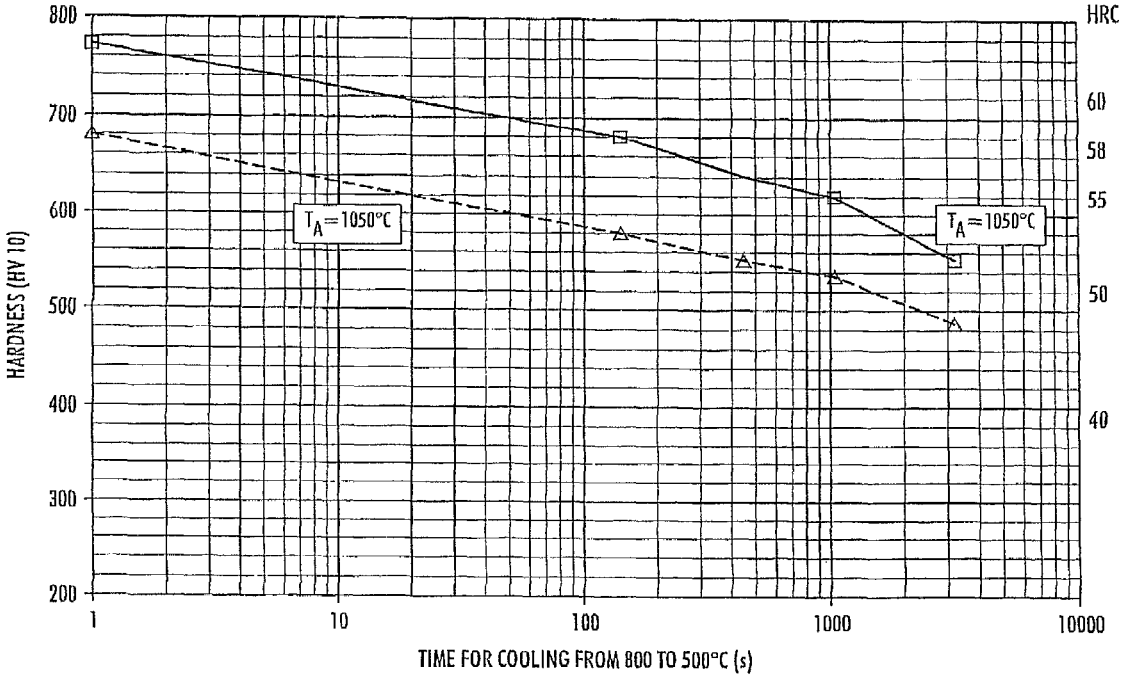
FIG. 6 shows CCT-diagrams, which illustrate the hardenability of a steel according to the invention and of a reference steel.

The hardness of steels No. 1 and No. 2 versus the required time for cooling from 800 to 500° C. is shown graphically in FIG. 6. From that chart can be stated that the hardenability of the spray-formed material No. 1 was definitely better than that of the powder metallurgy manufactured material No. 2 which had a higher content of vanadium and MC-carbides.

Toughness

Figure 7:
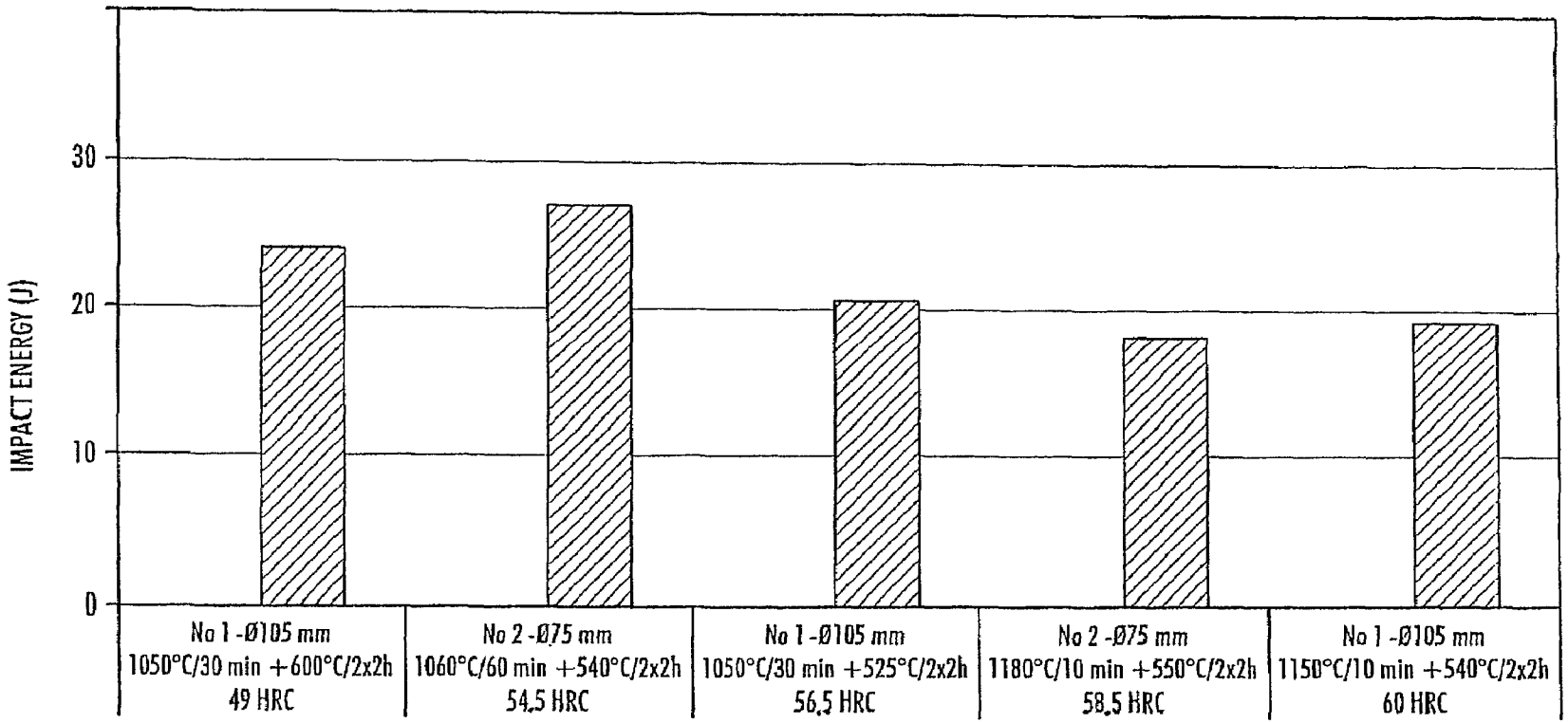
FIG. 7 shows the influence of heat treatment and dimensions of the articles on the ductility of some examined materials, and FIG. 8 in the form of a bar chart illustrates the abrasive wear resistances of a steel according to the invention and of a reference steel.

The impact energy was measured using un-notched test specimens after hardening from 1050° C./30 min+1150° C./10 min for steel No. 1 and varying tempering temperatures, and after hardening from 1060° C./60 min+540° C./2×2 h and 1180° C./10 min+550° C./2 ×2 h for steel No. 2 for varying rod dimensions of the two steels. The test specimens were taken in the centre of the rods in the most critical direction, i.e. the transversal direction. The results are apparent from FIG. 7, which shows that the ductility is slightly reduced when the hardness is increased, but generally speaking the ductility of the two steels is equally good. The impact energy at all measurements exceeded 10 J for all test specimens in the transversal direction, which satisfies the criteria of acceptable impact toughness as far as the intended fields of application of the article of the steel are concerned.

Abrasive Wear

The wear resistance was examined in the form of a pin-to-pin test using $SiO_2$ as an abrasive agent. As far as the dimensions and heat treatments of the examined materials are concerned the following applies.

Figure 8:
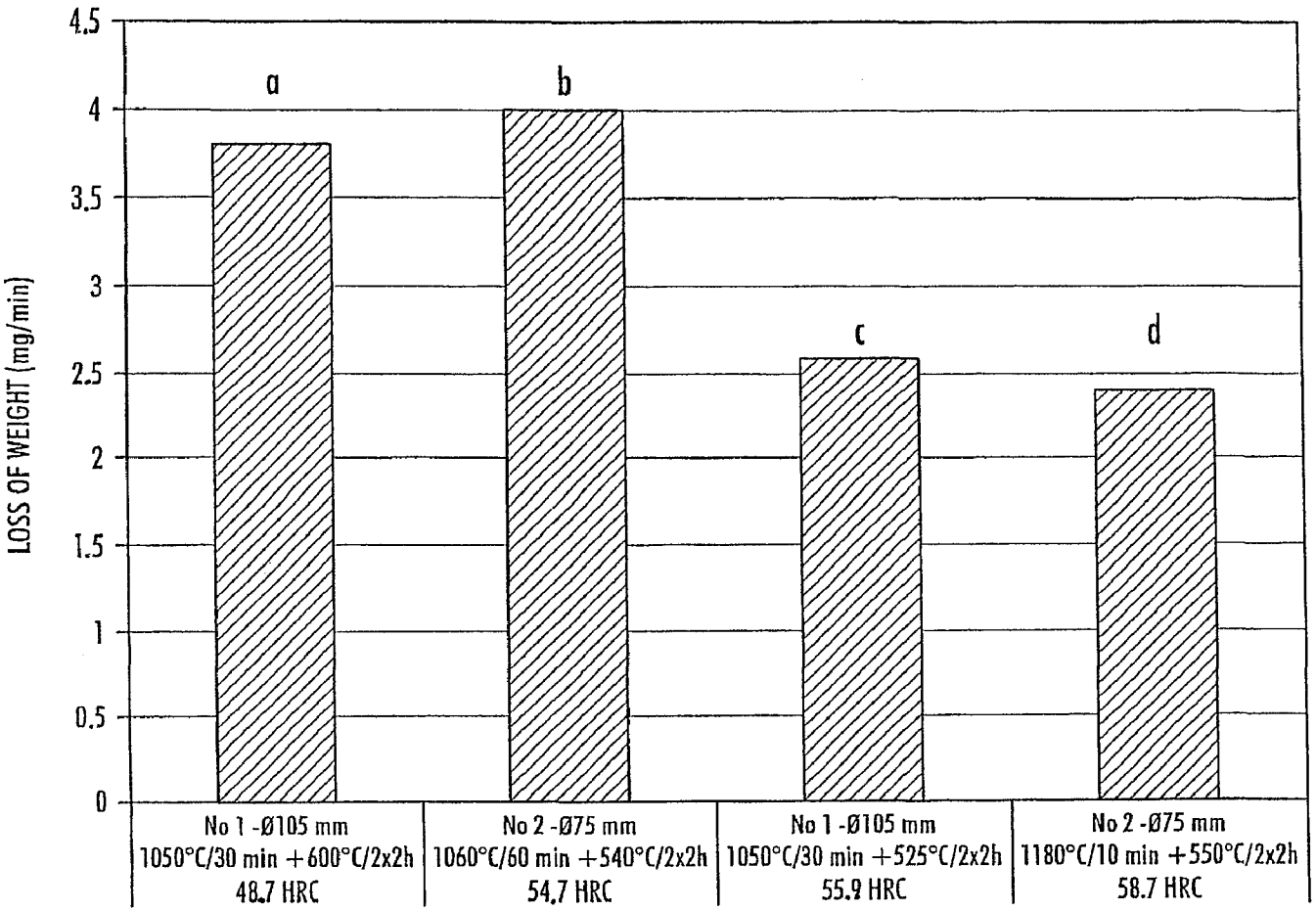

Steel No. 1, Ø 105 mm
a) 1050° C./30 min+600° C./2×2 h; 48.7 HRC
c) 1050° C./30 min+525° C./2×2 h; 55.9 HRC Steel No. 2, Ø 75 mm
b) 1060° C./60 min+540° C./2×2 h; 54.7 HRC
d) 1180° C./10 min+550° C./2×2 h; 58.7 ERC The results are apparent from the bar chart in FIG. 8. This chart illustrates that the materials No. 1 according to the invention, the bars a and c, in spite of a lower hardness and a lower total volume content of carbide, exhibited a wear resistance which was equally good as that of the comparative materials No. 2, the bars b and d.

DISCUSSION

The described experiments show that of the steel according to the invention there can be made articles having a very high wear resistance, which can be attributed in the first place to the material's content of MC-carbides in a sufficient amount and of a suitable size. Another important factor is the hardenability of the steel, which is very good and better than that of comparable steels. Hardnesses between 45 and 60 HRC adapted to the intended use of the material can be achieved through choice of austenitising and/or tempering temperature at the same time as an excellent wear resistance is maintained. The invention thus affords a pronounced flexibility as far as adaptability of the usefulness of the steel for different applications is concerned, through choice of a suitable heat treatment. Another important factor for the feasibility of the steel is its manufacturing, which is based on the spray-forming technique, which is essentially more economical than powder metallurgy manufacturing.

It should also be realized that the article according to the invention may have any conceivable shape, including spray formed ingots, blanks in the form of, e.g., plates, bars, blocks, or the like, which normally are delivered by the steel manufacturer in the soft annealed condition with a hardness of 190-230 HB, typically about 200-215 HB to the customers for machining to final product shape, as well as the final product which has been hardened and tempered to intended hardness for the application in question. Depending on the desired hardness for the intended application, the following heat treatments may be suitable:

for maximal toughness: 1050° C./30 min+590° C./2×2 h, which gives about 50 HRC for optimal combination of toughness and wear resistance: 1120° C./15 min+540° C./2×2 h, which gives about 56 HRC for maximal wear resistance: 1150° C./10 mim+540° C./2×2 h, which gives about (approximately) 60 HRC.

The experiments thus have shown that the material according to the invention has a number of favourable features as compared with the reference materials:

higher hardness after a comparable heat treatment
better wear resistance
at least equally good wear resistance
better hardenability
comparable toughness in the most critical direction; the transverse direction
lower production costs

The invention claimed is:

1. Process for producing a steel article comprising an alloy which contains in weight-%:

| | |
|---|---|
| 1.2-2.0 | C |
| 0.1-1.5 | Si |
| 0.1-2.0 | Mn |
| max 0.2 | N |
| max 0.25 | S |
| 4-8 | Cr |
| 0.5-3.5 | (Mo + W/2) |
| 5-8 | V |

balance essentially only iron and unavoidable impurities, said process comprising spray forming an ingot to produce an ingot comprised of a steel having a micro-structure containing 8-15 vol-% MC-carbides where M substantially consists of vanadium, of which carbides at least 80 vol-% have substantially rounded shape and a size in the longest extension of the carbides amounting to 1-20 μm.

2. Process according to claim 1 wherein droplets of molten alloy are sprayed against a rotating substrate to form said ingot.

3. Process according to claim 2 wherein said droplets undergo solidification at a rate which permits formation of carbides in which said at least 80 vol-% have said substantially rounded shape and said size in the longest extension of the carbides amounting to 1-20 μm.

4. Process according to claim 3, wherein said carbides formed upon solidification of said droplets are evenly distributed in said ingot.

5. Process according to claim 1, wherein said alloy contains in weight-%:

| | |
|---|---|
| 1.2-2.0 | C |
| 0.1-1.5 | Si |
| 0.1-2.0 | Mn |
| max 0.2 | N |
| max 0.25 | S |
| 4-8 | Cr |
| 0.5-3.5 | (Mo + W/2) |
| 5-8 | V |
| max. 1.0 | Nb |

balance essentially only iron and unavoidable impurities.

6. Process according to claim 5, wherein said alloy contains max 0.5% Nb.

7. Process according to claim 6, wherein sad alloy contains max. 0.3% Nb.

8. Process according to claim 7, wherein said alloy contains max. 0.1% Nb.

9. Process according to claim 8, wherein said alloy does not contain an intentionally added niobium.

10. Process according to claim 1, wherein the micro-structure contains 10-14.5 vol-% MC-carbides, of which the main part with reference to volume has a size in the longest extensions of the carbides larger than 3.0 μm and max. 10 μm.

11. Process according to claim 1, wherein, after spray forming, the alloy is subjected to hardening and tempering to thereby possess a hardness of 45-60 HRC.

12. Process according to claim 11, wherein, after the alloy is hardened and tempered, the martensitic matrix of the alloy contains 0.1-0.5 weight-% C in solid solution.

13. Process according to claim 1, wherein the total content of C in the alloy is at least 1.3%.

14. Process according to claim 1, wherein the total content of C in the alloy is at least 1.4%.

15. Process according to claim 1, wherein the total content of C in the alloy is max. 1.9%.

16. Process according to claim 1, wherein the total content of C in the alloy is max. 1.8%.

17. Process according to claim 1, wherein the alloy contains 0.1-1.0% Si.

18. Process according to claim 1, wherein the alloy contains max. 0.65% Si.

19. Process according to claim 1, wherein the alloy contains 0.2-1.5% Mn.

20. Process according to claim 1, wherein the alloy contains at least 4.2% Cr.

21. Process according to claim 1, wherein the alloy contains max. 6.5% Cr.

22. Process according to claim 21, wherein the alloy contains 4.5-5.5% Cr.

23. Process according to claim 1, wherein the alloy contains at least 6.0% V.

24. Process according to claim 1, wherein the alloy contains max. 7.8% V.

25. Process according to claim 24, wherein the alloy contains 6.8-7.6% V.

26. Process according to claim 1, wherein the alloy does not contain more than max. 0.04% Nb.

27. Process according to claim 1, wherein the alloy contains at least 1.5% Mo.

28. Process according to claim 1, wherein the alloy contains 1.8-2.8% Mo.

29. Process according to claim 1, wherein the alloy does not contain more than max. 1.0% W.

30. Process according to claim 1, wherein the alloy does not contain more than max. 0.5% W.

31. Process according to claim 1, wherein the steel does not contain more than max. 0.15% S.

32. Process according to claim 1, wherein the steel does not contain more than max. 0.08% S.

33. Process according to claim 11, wherein, after spray forming, said alloy is subjected to hardening from an austenitizing temperature in the temperature range 1000-1150° C., followed by tempering at a temperature in the temperature range between 590-640° C., twice for two hours each, to thereby possess a hardness of 48-53 HRC.

34. Process according to claim 11, wherein, after spray forming, said alloy is subjected to hardening from an austenitizing temperature in the temperature range 1000-1150° C., followed by tempering at a temperature in the temperature range between 540-610° C., twice for two hours each, to thereby possess a hardness of 54-58 HRC.

35. Process according to claim 11, wherein, after spray forming, said alloy is subjected to hardening from an austenitizing temperature in the temperature range 1050-1150° C., followed by tempering at a temperature in the temperature range 540-580° C., twice for two hours each, to thereby possess a hardness of 58-60 HRC.

* * * * *